US006209633B1

(12) United States Patent
Haynes

(10) Patent No.: US 6,209,633 B1
(45) Date of Patent: Apr. 3, 2001

(54) APPARATUS AND METHOD FOR AXIALLY DISPLACING A DOWNHOLE TOOL OR A TUBING STRING IN A WELL BORE

(76) Inventor: Michael Jonathon Haynes, Wilson Close 18, Sylvan Lake, Alberta (CA), T4S 1G2

( * ) Notice: Subject to any disclaimer, the term of this patent is extended or adjusted under 35 U.S.C. 154(b) by 0 days.

(21) Appl. No.: 09/448,640

(22) Filed: Nov. 24, 1999

Related U.S. Application Data

(63) Continuation-in-part of application No. 08/992,235, filed on Dec. 17, 1997, now Pat. No. 6,009,941.

(51) Int. Cl.[7] ..... E21B 23/00
(52) U.S. Cl. ..... 166/72; 166/77.51; 166/378
(58) Field of Search ..... 166/380–382, 166/387, 378, 313, 72, 77.51

(56) References Cited

U.S. PATENT DOCUMENTS

| | | | | |
|---|---|---|---|---|
| 4,403,654 | | 9/1983 | Haynes . | |
| 4,546,830 | | 10/1985 | McLaughlin et al. . | |
| 4,570,707 | * | 2/1986 | Setterberg | 166/214 |
| 5,049,037 | | 9/1991 | Carson et al. . | |
| 5,443,120 | | 8/1995 | Howell . | |
| 5,465,788 | | 11/1995 | Wright . | |
| 5,579,838 | | 12/1996 | Michael . | |
| 5,653,290 | * | 8/1997 | Bland | 166/381 |
| 5,706,892 | * | 1/1998 | Aeschbacher et al. | 166/66 |
| 5,927,307 | * | 7/1999 | King | 166/312 X |

* cited by examiner

*Primary Examiner*—Roger Schoeppel
(74) *Attorney, Agent, or Firm*—Nelson, Mullins, Riley & Scarborough, LLP

(57) ABSTRACT

An apparatus for axially displacing a downhole tool or a tubular in a well bore equipped with a wellhead is described. The apparatus includes a lifting mechanism such as an hydraulic cylinder or a mechanical jack that is connected to a lift rod string. The lift rod string includes a latch for engaging the tubular or the downhole tool. The apparatus further preferably includes a motor for rotating the lift rod string to permit rotationally releasable downhole equipment to be released by rotational movement of the lift rod string. The apparatus is also useful for removing obstructions in a casing of the well bore, and for removing soluble solids from a tubular in the well bore. The advantage is a simple, light weight, lifting apparatus that is versatile, yet inexpensively manufactured and readily transported from one wellhead to another.

40 Claims, 6 Drawing Sheets

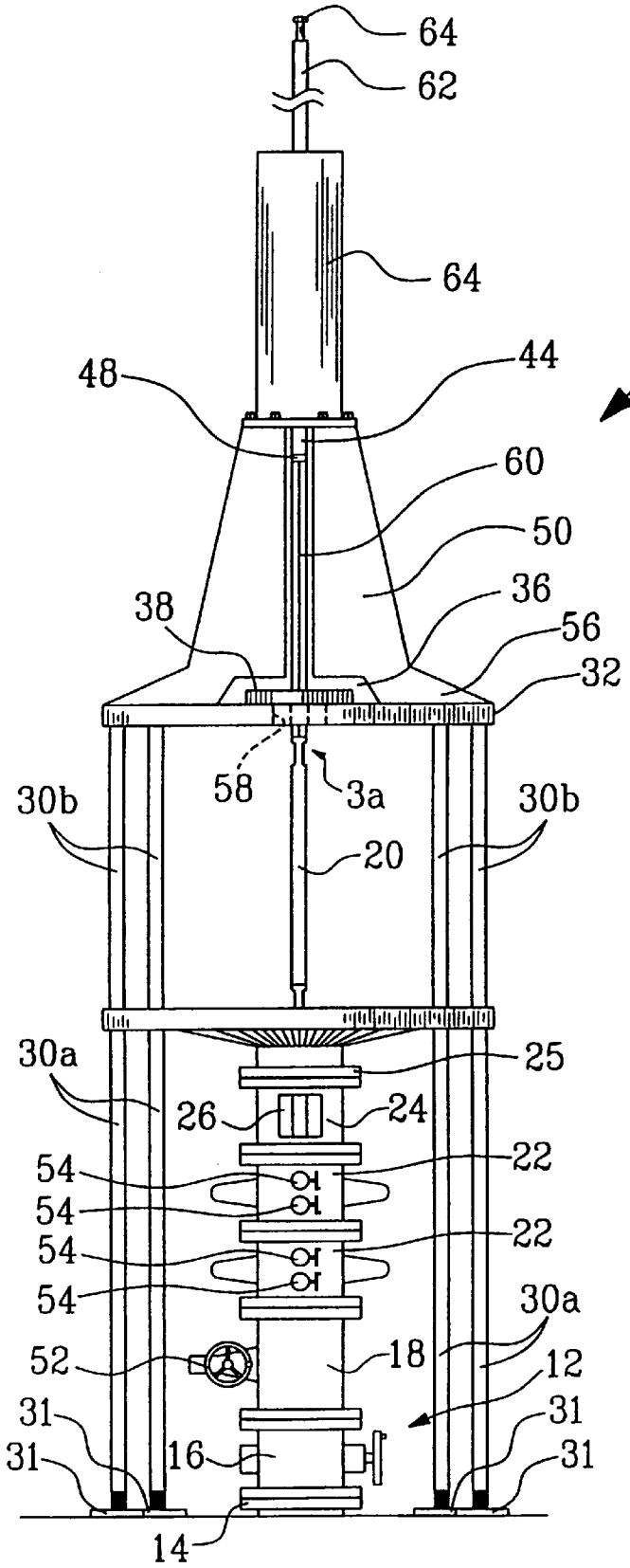
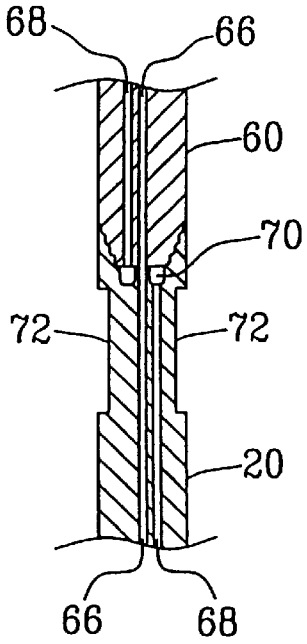
FIG. 3a
FIG. 3

APPARATUS AND METHOD FOR AXIALLY DISPLACING A DOWNHOLE TOOL OR A TUBING STRING IN A WELL BORE

CROSS-REFERENCE TO RELATED APPLICATIONS

This is a continuation-in-part of U.S. patent application Ser. No. 08/992,235 which was filed on Dec. 17, 1997 now U.S. Pat. No. 6,009,941.

TECHNICAL FIELD

This invention relates to the handling of downhole well tools and tubing strings, and in particular to an apparatus for axially displacing a downhole well tool or tubing string in a well bore equipped with a wellhead, the downhole well tool being supported by a tubing string in the well which includes a telescoping joint to permit the axial displacement of the downhole well tool and the tubing string. As well as any downhole operation in which well tubulars or downhole equipment is manipulated or downhole operations are performed in which pressure containment is necessary.

BACKGROUND OF THE INVENTION

Downhole operations and the handling of downhole well tools in completed wells has always presented a certain challenge, especially when working in wells having a natural pressure that exceeds atmospheric pressure, necessitating the containment of the well at all times. A further challenge has been the maintenance of well bores which pass through production zones that are not well suited to continuous production. For example, a production zone which yields both water and oil or gas or any combination thereof may require relatively frequent repositioning of a lower end of a production tubing in order to recover oil or gas efficiently. Production zones which produce crude oil high in waxy compounds or asphaltines, or laden with salts, which tend to plug casing perforations and therefore require frequent treatment to maintain an economic flow of hydrocarbon are further examples of such production zones.

To date, the maintenance of such wells has proven time-consuming and expensive. For example, in wells which produce both oil, water and gas and/or water and gas and have a mobile water/hydrocarbon interface, the production of hydrocarbon gradually decreases over time until only water or gas is produced from the well. Relocation of the bottom end of the production tubing string is then required to recommence oil production. The relocation of the tubing string has been a complex process which involved many time-consuming and expensive steps that are well known in the art. It is not difficult to appreciate that there is a need for a more efficient and less costly system for producing oil or gas from such wells. Such a system is described in applicant's copending patent application incorporated herein by reference. The apparatus described in that patent application eliminates many of the shortcomings of prior art procedures for selectively producing fluids from wells, performing barefoot completions of well bores in sensitive zones, and other downhole operations using production tubing and tools that require axial displacement within a limited range in a well bore. At the time of filing that patent application, it was considered that the apparatus described in U.S. Pat. No. 4,867,243 which issued on Sep. 19, 1989 to Garner et al. would be suitable for effecting the axial displacement of the downhole well tools. It has now been recognized that such prior art tools for inserting mandrels through wellheads is not necessarily adequate or optimal for performing the axial displacement of such downhole well tools.

There are several reasons why such prior art tools are not optimal tools for this purpose. First, they are designed for inserting wellhead isolation mandrels into wellheads and withdrawing them from the wellheads after the well is serviced. Since wellhead isolation mandrels are of inconsequential weight, they are stroked through a wellhead relatively easily. Moving a tubing string of 4,500' (1,500 meters), which is not uncommonly encountered in handling downhole well tools, may require a force in excess of 50 tons. The force required is due not only to the considerable weight to be lifted but also to the extra force required to unseat anchors and/or packers supporting the tubing string. Such forces may subject the wellhead to potentially damaging stresses. Second, wellhead isolation tools provide no mechanism for rotating a downhole tubing string since rotation is not required for the insertion or withdrawal of a wellhead isolation mandrel. When manipulating a downhole tubing string, however, rotational movement is often required in order to release or set components such as packers, anchors, hangers and the like. Considerable rotational force may be required to accomplish the release of such components and it is therefore desirable to provide a mechanism for selectively rotating the downhole string as required.

It has also now been recognized that certain downhole operations can be more economically performed through the wellhead with pressure containment than performing those operations using a rig, for example. It is also known that certain near-surface operations such as the drilling out of permanent bridge plugs, cement plugs or any other obstruction in the casing column during re-entries require pressure containment in order to avoid the escape of hydrocarbons to atmosphere and potentially dangerous releases of contained pressure. There therefore exists a need for an apparatus which is adapted to provide pressure containment while enabling downhole manipulations to move production tubing, and remove near-surface obstructions with or without the use of a telescoping joint in a tubing string.

SUMMARY OF THE INVENTION

It is an object of the invention to provide an apparatus for axially displacing a downhole tool or tubing string in a well bore equipped with a wellhead which is robust enough to permit a lengthy tubing string to be displaced in the well bore.

It is a further object of the invention to provide an apparatus for axially displacing a downhole tool or tubing string in a well bore equipped with a wellhead which permits a tubing string alone or a tubing string supporting the downhole tool to be rotated, if required.

It is yet a further object of the invention to provide an apparatus for axially displacing a downhole tool or tubing string in a well bore equipped with a wellhead which is stabilized to reduce stress on the wellhead.

It is yet a further object of the invention to provide an apparatus for axially displacing a downhole tool or tubing string in a well bore equipped with a wellhead which is safe to use.

It is also an object of the invention to provide an apparatus for axially displacing a downhole tool or tubing string in a well bore equipped with a wellhead which is readily transported from one well bore to another.

It is a further object of the invention to provide an apparatus for performing downhole operations which require pressure containment at the wellhead.

These and other objects of the invention are realized in an apparatus for axially displacing a downhole tool or tubing string in a well bore equipped with a wellhead, the downhole tool being supported by a tubing string in the well which includes a telescoping joint to permit the axial displacement of the tool, comprising:

a lift rod string;

a tool entry spool adapted to be mounted to a top of the wellhead;

at least one annular seal for containing well pressure mounted above the tool entry spool, the annular seal providing a fluid seal around a periphery of the lift rod string;

means for axially displacing the lift rod string;

means for selectively rotating the lift rod string; and a swivel joint for enabling free rotational movement in a link rod between the means for axially displacing the lift rod string and the means for selectively rotating the lift rod string.

The apparatus in accordance with the invention includes a lift rod string which is equipped with a releasable latch tool for connecting a free end of the lift rod string to a latch point in or near a telescoping joint described in applicant's copending patent application, or connected directly to a tubing string. The lift rod string is supported on its top end by a stem which is connected to the means for selectively rotating the lift rod string. The means for selectively rotating the lift rod string is preferably a motor. A hydraulic or an electric motor or a mechanical rotational device can be used. Attached to the stem for supporting the lift rod string is a link rod that includes a swivel joint for enabling free rotational movement between the stem for supporting the lift rod string and the means for axially displacing the lift rod string. The means for axially displacing the lift rod string is preferably a hydraulic cylinder or a mechanical jack, but any other hoisting mechanism may be used.

In preferred embodiments of the apparatus designed for use on deep wells, the apparatus is supported and stabilized by adjustably extendible support posts designed to rest on a ground surface surrounding the wellhead. The support posts help bear the weight of heavy tubing strings and stabilize the apparatus to reduce torsional stress on the wellhead.

The apparatus preferably includes a tool entry spool adapted to be mounted to a top of the wellhead. The tool entry spool provides a space for accommodating a latch tool such as a spear, key, collet, slip or friction type tool, attached to the bottom end of the lift rod string. Mounted above the tool entry spool is at least one annular seal for containment of well pressure. The annular seal may be a stuffing box, but it is preferably one or more blowout preventers. Desirably, a spool which includes at least one tool window is provided above the blowout preventer. The tool window provides access to the lift rod string with gripping or locking devices useful for inhibiting axial or rotational movement while lift rod joints are being inserted or removed. Alternatively, a pair of oppositely oriented well slip assemblies such as described in U.S. Pat. No. 3,846,877 which issued on Nov. 12, 1974 to Spiri, the entire specification of which is incorporated herein by reference, can be used in place of the tool access spool to selectively inhibit axial or rotational movement of the lift rod string.

Each joint of the lift rod string may include axial bores which permit fluid to be circulated or pumped straight through the lift rod string, if required. For example, conditions are sometimes encountered in wells such as gas wells where hydrating frequently occurs at or near the well surface. Such hydrates can prevent entry or retrieval, or foul or seize latch tools such as spears, keys, collets, slips type or friction type tools and prevent their release or proper functioning. If the lift rod string includes axial bores to permit the circulation of hot fluid, the string can be heated to melt ice or paraffins, etc. and free up the seized component to effect the desired release. One way of circulating fluid through the lift rod string is to use aligned bores that extend through the means for axially displacing the lift rod string so that a fluid connection can be made at the top of the apparatus. If a hydraulic cylinder is used for axially displacing the lift rod string, the hydraulic cylinder is provided with a polished rod that extends through a top of the cylinder. A free end of the polished rod is equipped with threaded connectors for the attachment of fluid circulation hoses which are in turn connected to a pump and a heated reservoir. It may also be desirable to pump fluid straight through a lift rod string. This can be advantageous for clearing hydrates or paraffin buildup from a production tubing. One way of accomplishing this is by modifying the spear, collet, slip or friction type tool to let fluid flow out a bottom end of the lift rod string, or to run in the lift rod string without a tool on its bottom end so that fluid can be pumped through one or both axial bores.

The apparatus in accordance with the invention may also be used to axially or rotationally displace tubulars in a well bore that are not equipped with telescoping joints. If slip or spear latch tools, for example, are used, a production tubing, or the like, can be repositioned in a well without killing the well or removing the wellhead. Depending on the downhole components associated with the tubing string, it is possible and practical to remove an entire production tubing string from a well without removing the wellhead.

The apparatus in accordance with the invention also enables downhole operations, in particular near-surface operations which require pressure containment. Such operations include the drilling out of permanent bridge plugs, cement plugs or any other obstruction in the casing column near the surface during re-entries to a well bore.

Although the apparatus in accordance with the invention is versatile and robust, it may be easily disassembled for transport to another well site. It can also be transported without disassembly, permitting well bores to be readily serviced at minimal cost.

BRIEF DESCRIPTION OF THE DRAWINGS

The invention will now be explained by way of example only, and with reference to the following drawings wherein:

FIG. 3 is an elevational view of a second preferred embodiment of an apparatus in accordance with the invention;

FIG. 3*a* is an enlarged cross-sectional view of a connection between a stem and a lift rod joint in accordance with the invention, showing the arrangement of fluid circulation bores in each;

DETAILED DESCRIPTION OF THE PREFERRED EMBODIMENT

This invention relates to an apparatus for axially displacing a downhole tool or a tubing string in a well bore equipped with a wellhead, the downhole tool being supported by the tubing string in a well to permit axial displacement of the downhole tool or tubing string. The apparatus in accordance with the invention may also be used for performing downhole operations that require pressure containment to ensure that hydrocarbons are not released to atmosphere and concessive pressure releases do not occur during such operations.

Figure 1:
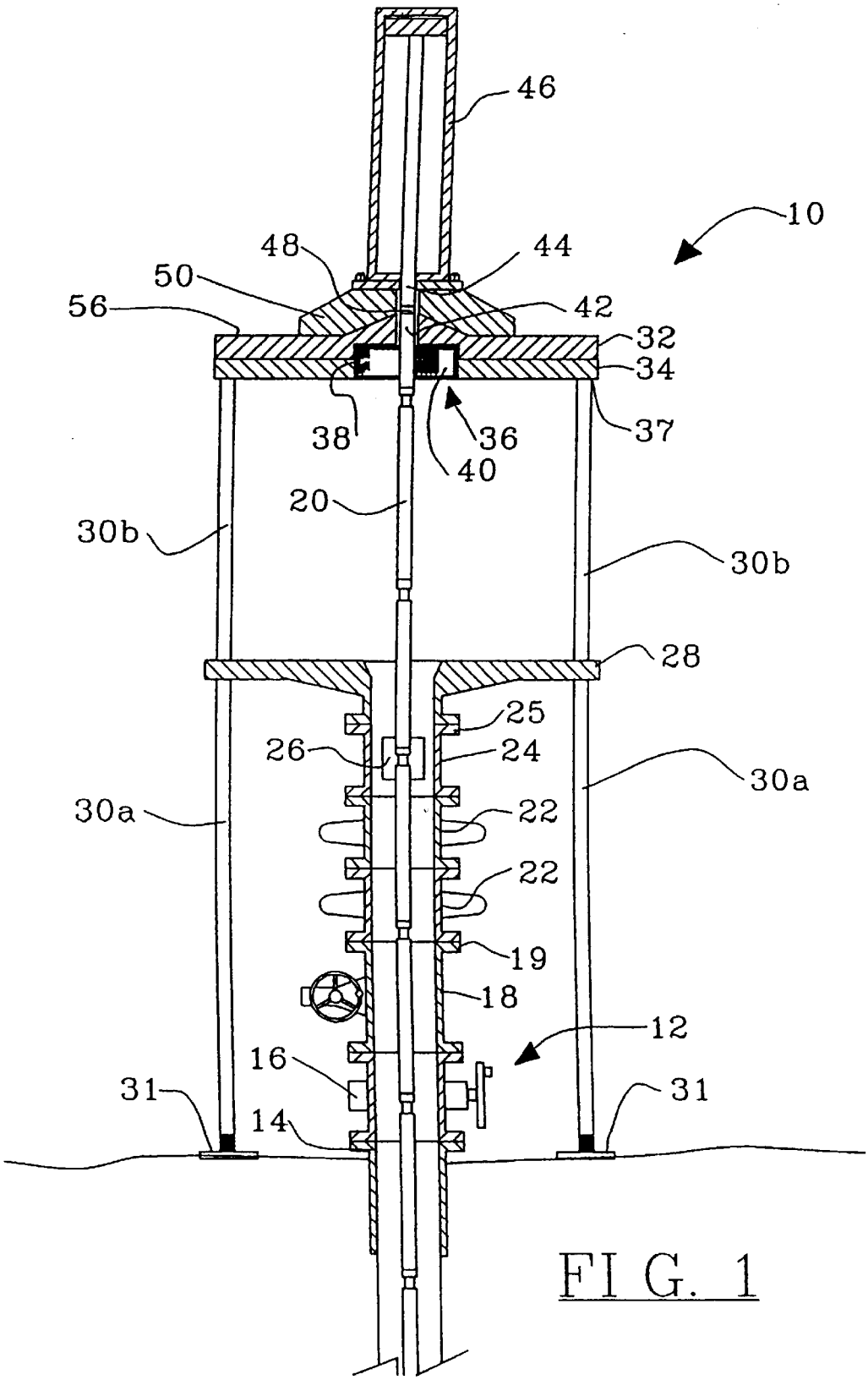
FIG. 1 is a cross-sectional view of a first preferred embodiment of the apparatus in accordance with the invention connected to a wellhead of a well bore.

FIG. 1 shows a cross-sectional view of a first preferred embodiment of an apparatus in accordance with the invention, generally indicated by the reference 10. The apparatus is mounted to a top of a wellhead generally indicated by reference 12. Typically, the wellhead 12 includes a surface spool 14 and a master valve spool 16, the structure of each being well known in the art. Some wellheads do not include master valves. Mounted to a top of the master valve spool 16 or an uppermost part of the wellhead is a tool entry spool 18, which is the lowermost component of the apparatus 10. The tool entry spool 18 accommodates a latch tool 96 (see FIG. 6) for connecting a lift rod string 20 to a latch point 94 of a telescoping joint 90 or directly to a downhole tubular when the lift rod string 20 is run into the well bore, as well as when it is removed from the well bore, as will be explained in detail with reference to FIG. 6. Mounted to a top flange 19 of the tool entry spool 18 is an annular seal for containing well pressure, such as a blowout preventer 22. As will be understood by those skilled in the art, other annular seals for containing well pressure can be adapted for use with the apparatus 10. For example, certain stuffing box structures or multiple ram type or annular preventers can be adapted for such use. The blowout preventer 22 is preferred, however, because of the ease of use and the security of the seal it provides. Preferably, the apparatus includes two blowout preventers 22 connected in sequence in order to increase the safety of the apparatus and to provide extra room between the master valve spool 16 and the uppermost blowout preventer 22 to accommodate latch tools 96 of different lengths. With two or more blowout preventers safety is increased because the preventers can be opened and closed in sequence at each lift rod joint connector in the lift rod string to prevent tears in sealing surfaces which can result from forcing rough surfaces at the connectors through a closed preventer. For this reason, it is preferable that the adjacent preventers be spaced about 10–13 cm (4"–5") apart to accommodate a lift rod joint connector between them.

Mounted to a top of the uppermost blowout preventer 22 is a tool access spool 24 having at least one tool window 26 or an integral locking mechanism (not illustrated). The tool window 26 permits gripping or locking devices to be inserted for engaging the lift rod string. As will be explained below in some detail, the tool window 26 permits the lift rod string 20 to be gripped to permit joints to be added to, or removed from, the lift rod string 20. It also permits the lift rod string 20 to be locked against axial movement when joints are being added to, or removed from, the lift rod string 20. For example, the weight of the tubing string 94 can be supported at the tool window 26 in low pressure wells while lift rod string joints are being added, or removed. If wells with exceptionally high pressure are being worked, a lock inserted through the tool window 26 prevents the lift rod string 20 from being forced up out of the well bore while joints are being added to, or removed from, the lift rod string.

The tool access spool can be replaced by a pair of oppositely oriented well slip assemblies described in U.S. Pat. No. 3,846,877 to Spiri. Preferably, two oppositely oriented slip tools are mounted to a top of the uppermost blowout preventer 22. They may be operated separately, or in unison, to control axial or rotational movement of the lift rod string 20, as required by well and/or operating conditions.

Bolted to the top flange 25 of the tool access spool 24 is a lower support plate 28 which is preferably supported by a plurality of support posts 30a to reduce compressive and torsional forces on the wellhead which may be induced by the lifting and manipulation of heavy production tubing strings. The number of support posts 30*a* is a matter of design choice. Preferably at least three are provided and four support posts 30*a* are considered more appropriate for supporting the lower support plate 28. Located above the lower support plate 28 is an upper support plate 32 which is supported by support posts 30*b*. The support posts 30*b* may be integral extensions of support posts 30*a* or may be separate posts which threadably engage threaded bores in the lower support plate 28. For the sake of rigidity and optimal support, it is preferable that the support posts 30*a* and 30*b* be integral and that the support posts 30*a,b* pass through bores in the lower support plate 28. The support posts 30*a,b* may be secured to the lower support plate 28 in any one of several ways well known in the art, such as pins, wedges, set screws or the like.

Reciprocally moveable between the lower support plate 28 and the upper support plate 32 is a travelling support plate 34. The travelling support plate 34 includes bores 37 which receive the upper support posts 30*b* with adequate clearance to permit the travelling support plate 34 to move reciprocally between the upper support plate 32 and the lower support plate 28 without undue resistance. The support posts 30*b* stabilize the travelling support plate 34 and inhibit it from rotational movement when a motor 36 is operated to rotate the lift rod string 20. Affixed to the travelling support plate 34 is the motor 36 for selectively rotating the lift rod string 20. The stator 38 of the motor 36 is mounted to the travelling support plate 34 and the rotor 40 is attached to a link rod 42. The link rod 42 connects the lift rod string 20 with a piston rod 44 of a hydraulic cylinder 46, which provides the motive of force for axially displacing the lift rod string 20 and the tubing string 94 to which it is attached, as will be explained below in more detail with reference to FIG. 6. The motor 36 may be a hydraulic motor or an electric motor, for example. A hydraulic motor such as the Bowen PS-60 Power Sub available from Bowen Tools, Inc., a division of IRI International Corporation, is suitable for most applications. An electric motor with equivalent torque can also be used.

Interconnecting the link rod 42 and the piston rod 44 is a swivel joint 48 which permits free rotation of the link rod 42 with respect to the piston rod 44 to permit the lift rod string 20 to be selectively rotated without causing damage or wear in the hydraulic cylinder 46. The hydraulic cylinder 46 is mounted to a top surface 56 of the upper support plate 32 by one or more mounting brackets 50 in a manner well understood in the art.

Figure 2:
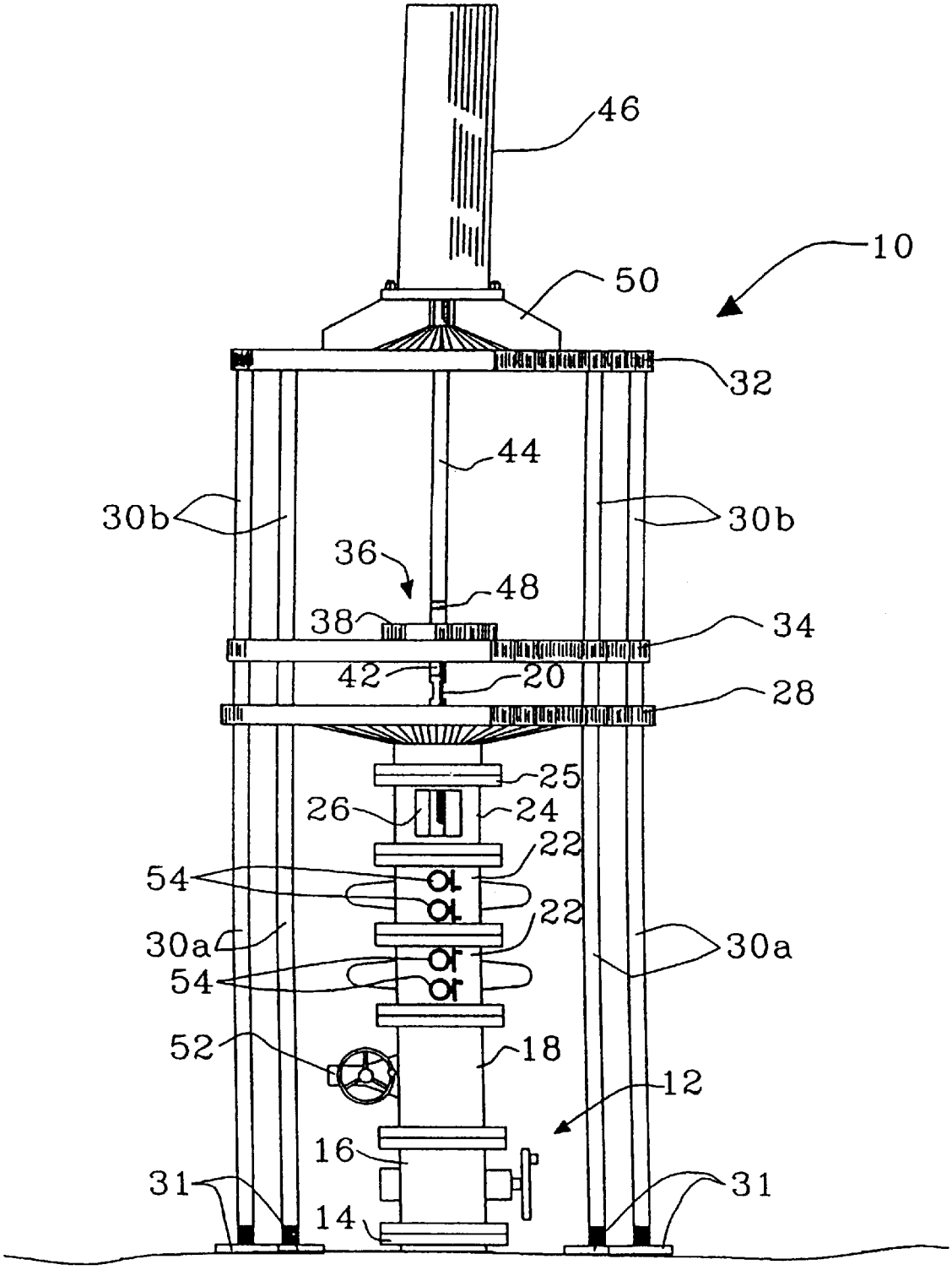
FIG. 2 is an elevational view of the apparatus shown in FIG. 1.

FIG. 2 shows an elevational view of the apparatus 10 shown in FIG. 1. As described above, four supports posts 30*a,b* preferably support the lower support plate 28, the upper support plate 32 and stabilize the travelling support plate 34. In plan view, the respective support plates 28, 32 and 34 may be square, circular, hexagonal or any other convenient shape. The travelling support plate 34 is shown in a position in which the piston rod 44 is nearing an end of its stroke. As described above, the travelling support plate 34 freely reciprocates between the lower support plate 28 and the upper support plate 32 with the extension and retraction of the piston rod 44. The only other component of the apparatus shown in FIG. 2 which was not described above is a valve 52 preferably provided on the tool entry spool 18. The valve 52 permits the release of well pressure after the lift rod string 20 has been withdrawn from a well and the master valve 16 has been closed but before the BOPs 22 are opened. Each BOP 22 also includes one or more of bleed off or equalization valves 54, which are well known in the art. The operation of the apparatus shown in FIG. 2 will be described below with reference to FIG. 6.

FIG. 3 shows an elevational view of another preferred embodiment of the apparatus in accordance with the invention. The apparatus shown in FIG. 3 is similar to that shown in FIGS. 1 and 2 with the exception that the travelling support plate 34 is eliminated and the stator 38 of the motor 36 is mounted to a top surface 56 of the upper support plate 32. As shown in dotted lines, the upper support plate includes a guide roller assembly 58 through which a splined link rod 60 extends. The splined link rod meshes with a splined hub (not illustrated) of the rotor 40 (see FIG. 1) of the motor 36. The splined link rod 60 reciprocates through the splined hub to permit the lift rod string 20 to be axially displaced. A swivel joint 48 connects the piston rod 44 to the splined link rod 60 as described above with reference to FIG. 1. The mounting brackets 50 which support the hydraulic cylinder 46 are elongated to support the hydraulic cylinder about the length of its stroke above the upper support plate 32.

Figure 4:
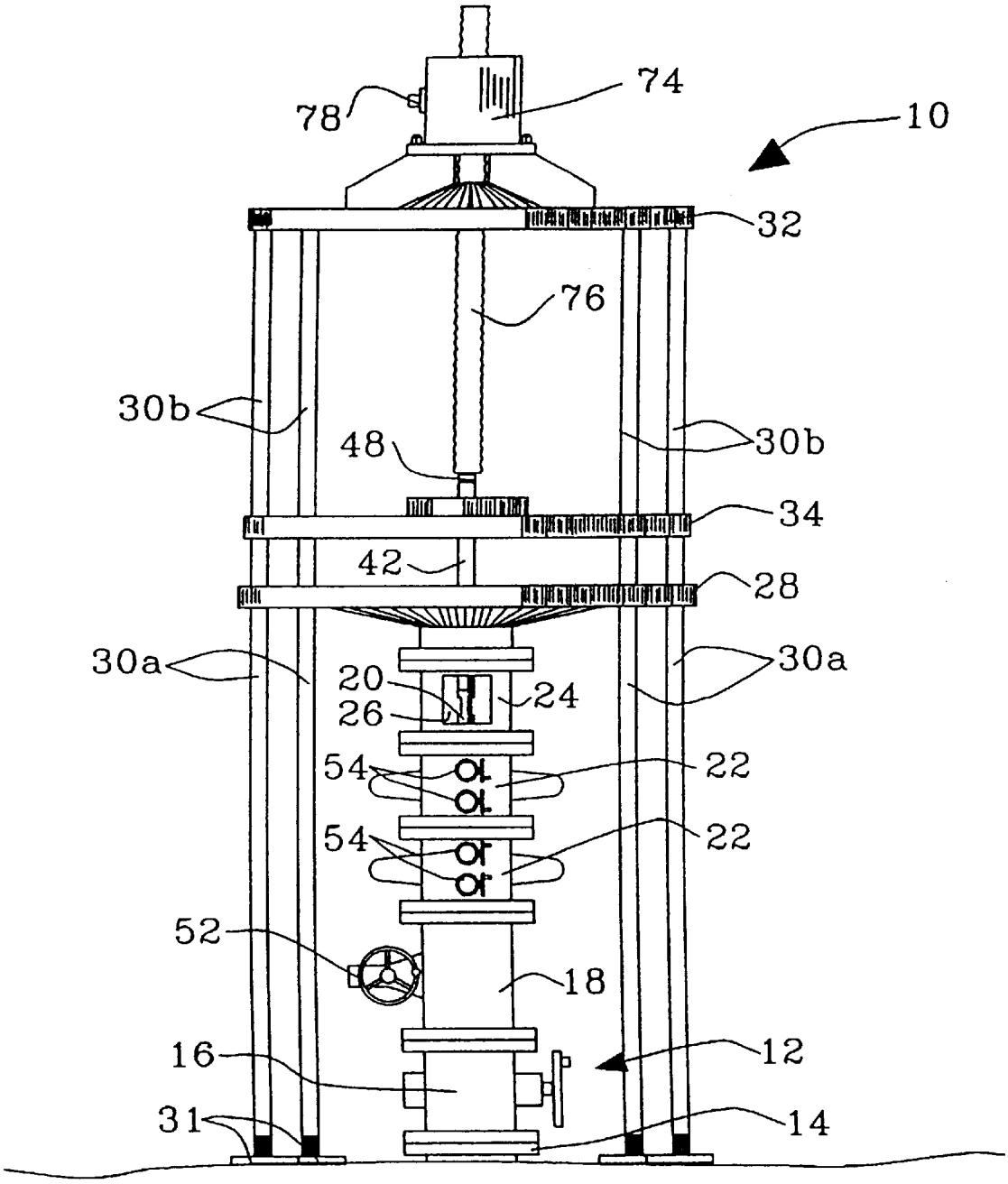
FIG. 4 is an elevational view of another preferred embodiment of the apparatus in accordance with the invention.
Figure 5:
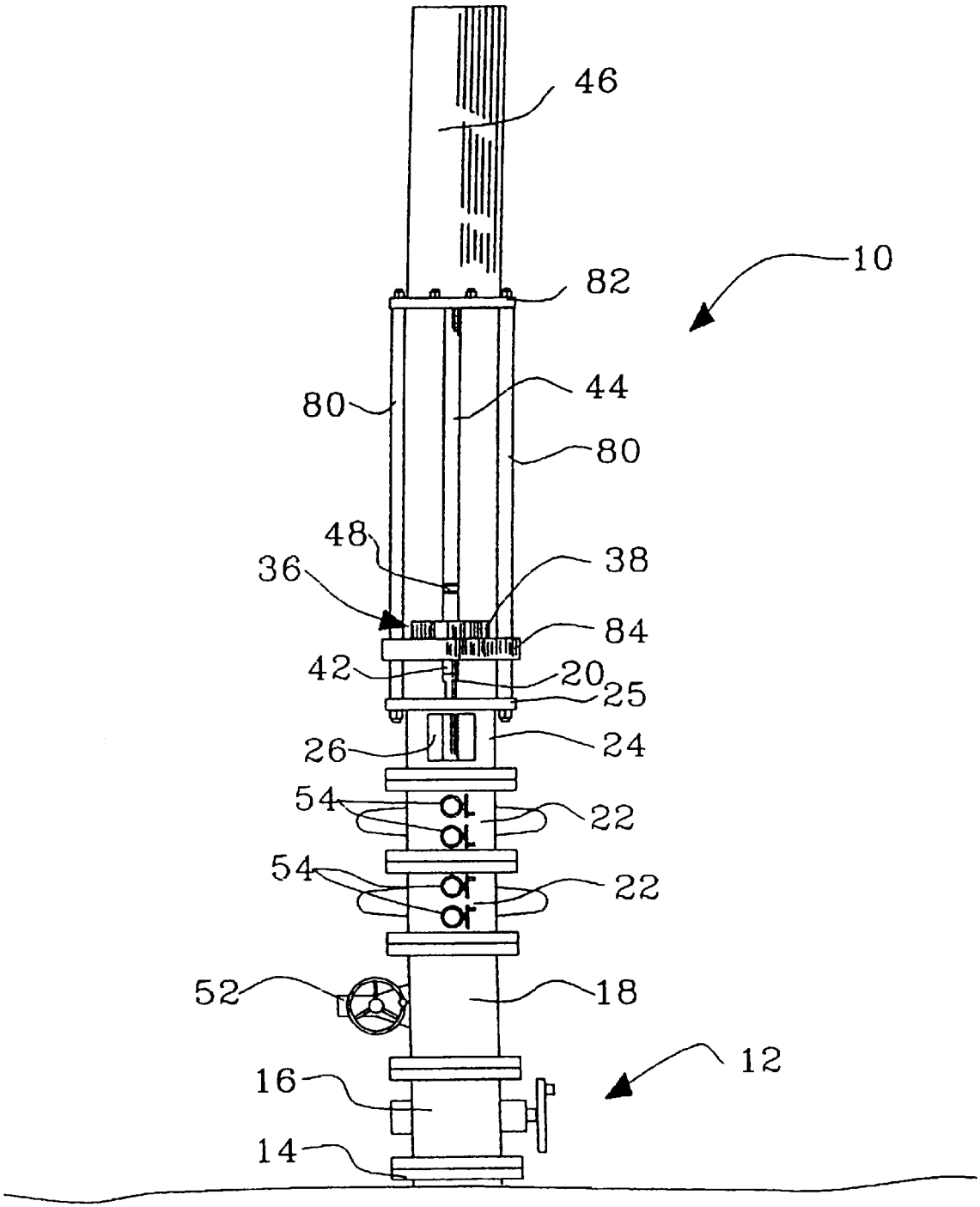
FIG. 5 is an elevational view of yet a further preferred embodiment of the invention suitable for use in shallow wells where production tubing string weights are moderate.

The embodiment shown in FIG. 3 also illustrates a further feature of the invention which may be implemented in the embodiments shown in FIGS. 1, 4 or 5 as well. In the embodiment shown in FIG. 3, a polished rod 62 extends through a top end of the hydraulic cylinder 46. The polished rod 62 is attached to the piston of the hydraulic cylinder 46 and reciprocates with the piston through seals in a top wall of the hydraulic cylinder 46 in a manner well known in the art. A top end of the polished rod 62 includes connectors 64 to which fluid circulation hoses may be attached. The fluid circulation hoses permit fluids to be circulated through axial bores in the polish rod 62, the piston of the hydraulic cylinder 46, the cylinder rod 44, the swivel joint 48, the splined link rod 60 and each joint of the lift rod string 20. The fluid circulation bores are useful in certain instances where it is advantageous to circulate fluid through the lift rod string 20. For example, in certain gas wells it is not unusual to have hydrate conditions near the top of the well bore in which ice accumulates on tools and connections. In oil wells, paraffins accumulate on tools and connectors. Under either of these conditions, it is possible for a latch tool 96 (FIG. 6) such as a spear, key, collet, friction or slip type connector to freeze or become clogged with hydrates or paraffins. If that happens, it may not be possible to release the latch tool 96 or move the lift rod string 20 unless the latch tool 96 can be heated to melt accumulated hydrate or paraffin deposits. It is therefore advantageous to circulate heated fluid such as heated oil through the lift rod string 20 when this occurs.

FIG. 3*a* shows an enlarged cross-sectional view of the connection between the lift rod string 20 and the splined link rod 60. Joints in lift rod string 20 have similar connectors. A fluid circulation bore 66 is an axial bore which extends through each lift rod string joint 20 and the splined link rod 60 so that the ends of the bores are connected when the two are securely screwed together. A recirculation bore 68 is radially offset from the fluid circulation bore 66. Since the recirculation bore 68 in one component may not align with the recirculation bore 68 in the other component when two joints are connected, a recirculation chamber 70 is machined in the bottom of each female component of the joint so that a fluid recirculation path is enabled even though the two recirculation bores 68 are not aligned when the components are securely connected. The swivel joint 48 is constructed in the same manner to permit the swivel joint to freely turn while ensuring that fluid circulation is not inhibited.

FIG. 3*a* also shows a further feature of the invention in which each joint of the lift rod string 20 includes opposed peripheral areas of reduced diameter to provide parallel tool gripping surfaces 72 that are adapted to be engaged by a clamping or securing device to permit joints to be added to, or removed from, the lift rod string 20 and to permit the lift rod string 20 to be secured to prevent axial movement when joints are added or removed. Clamping or securing devices used for this purpose are well known in the art and may include wrenches or hydraulic or mechanical clamps, all of which are commercially available.

FIG. 4 shows yet another embodiment of the apparatus 10 in accordance with the invention. The embodiment shown in FIG. 4 is identical to the embodiment shown in FIG. 1 with the exception that the hydraulic cylinder 46 is replaced with a mechanical jack 74 that has an axially displaceable jackpost 76, such as a ball jack which is well known in the art. A lower end of the jackpost 76 is affixed to the swivel joint 48 which is in turn affixed to the link rod 42. Reciprocal movement of the jackpost 76 is effected by rotation of a drive shaft 78. The drive shaft 78 may be rotated by a hydraulic motor, an electric motor or the like, as appropriate. A mechanical jack such as the ball jack 74 is capable of securely moving significant loads and provides a safe mechanism for shifting the position of very long tubing strings in deep wells.

FIG. 5 shows another preferred embodiment of the invention principally intended for use on shallow wells where production tubing strings are of a weight that is safely supported directly by the wellhead. In this embodiment, support posts 80 are bolted directly to a top flange 25 of the tool access spool 24. The number of support posts 80 is a matter of design choice but at least three are required and preferably at least four are used. The top end of the support posts 80 are bolted directly to a bottom flange 82 of a hydraulic cylinder 46 and supports the hydraulic cylinder 46 above the tool access spool 24. A smaller version of the travelling support plate indicated by reference 84 reciprocates with movement of the piston rod 44 as explained above with reference to FIG. 1. The stator 38 of the motor 36 is mounted to the travelling support plate 84, as also explained with reference to FIG. 1. In operation, the apparatus shown in FIG. 5 functions the same as the apparatus described above with reference to FIGS. 1–4. The apparatus is somewhat lighter and easier to handle, which makes it ideal for use in areas where there are an abundance of shallow wells that require service.

Figure 6:
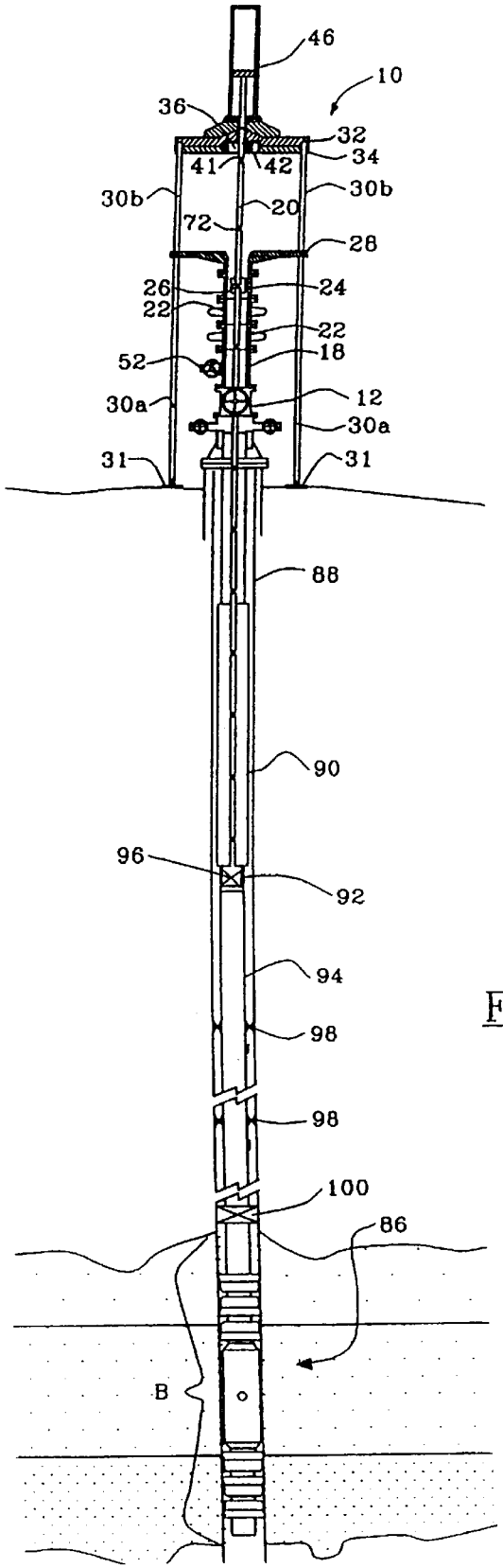
FIG. 6 is a cross-sectional view of the apparatus shown in FIG. 1 connected to a telescoping joint described in applicant's copending patent application.

FIG. 6 is a cross-sectional view of the apparatus 10 described above with reference to FIGS. 1 and 2 mounted to a wellhead in which a production tubing 94 produces oil from a formation B that bears gas, oil and water. As is understood by those skilled in the art, such wells may require frequent service in order to maintain oil production as the gas/oil/water interface moves upwardly or downwardly with the production of hydrocarbons from the well. In certain areas, the gas/oil/water interface may move upwards several feet annually. In order to produce principally a selected fluid from such formations, the applicant has invented an apparatus generally indicated by reference 86 for isolating fluid zones in a casing 88 of a well bore. Periodically, the apparatus 86 must be repositioned within the casing 88. This is accomplished using one of the preferred embodiments of the apparatus 10 in accordance with the invention. In an initial step in the process, the apparatus 10 is attached to the top of the wellhead 12 as described above with reference to FIGS. 1–5. If the well is a deep well, the apparatus is preferably one of those described with reference to FIGS. 1–4. If the well is a shallow well, any one of the apparatus shown in FIGS. 1–5 may be used.

After the apparatus 10 is bolted to a top of the wellhead 12, the adjustable support pads 31 located respectively at the base of each support leg 30*a* are adjusted so that the apparatus 10 is level and the support legs 30*a* will share the load to be placed on the apparatus 10 when the lift rod string 20 supports the tubing string 94. Once the apparatus 10 is properly set up, the lift rod string 20 is assembled using a plurality of joints which are interconnected. Attached to a free end of the first joint is a latch tool 96 for releasably connecting to a latch point 92 of a telescoping joint 90 described in applicant's copending patent application. The telescoping joint 90 permits the tubing string 94 and the apparatus for isolating fluid zones 86 to be axially displaced in the casing 88. The latch point 92 is engaged by any one of a number of well known latch tools 96 which may include quick-disconnect threads, spears, keys, collets, friction or slip type tools, releasable packers or rotary taper taps, each of which is commercially available from several manufacturers and well known in the art. The latch tool 96 is shown in an engaged position with the latch point 92 at the bottom of the telescoping joint 90. After the lift rod string 20 has been extended down through the telescoping joint 90 and a connection with the latch point 92 has been effected, the downhole tool 86 may be raised or lowered within the range of the telescoping joint 90. This permits a variety of downhole tool manipulations to accomplish tasks such as those described in applicant's copending patent application without setting up a derrick or bringing in a crane, killing the well or performing many of the other steps required using prior art methods.

To run the lift rod string 20 into the well, a latch tool 96 is attached to a first joint of the lift rod string 20 and the joint is connected to the stem 41 at the end of the link rod 42. The hydraulic cylinder is extended until the tool grip surfaces 72 are in the tool window 26 of the tool access spool 24. The tool grip surfaces 72 are then engaged using a locking tool inserted through the tool window 26, the motor 36 is operated to release the stem 41 from the first joint of the lift rod string 20, the piston of the hydraulic cylinder is stroked back to the top of the cylinder 46 and another lift rod joint is added between the first joint and the stem 41. The hydraulic motor 36 is operated to make the connection between the first and second joints of the lift rod string 20 and the stem 41. The locking tool is then released from its grip on the tool grip surfaces 72 of the lift rod string 20, the hydraulic cylinder 46 is stroked downwards until the tool grip surfaces 72 of the second joint appear in the tool window 26, and the process is repeated until the latch tool 96 engages the latch point 92 of the telescoping joint 90. After engagement of the latch tool 96 with the latch point 92, the lift rod string 20 is tensioned to remove weight from compression anchors, hangers or packers 98 which support the tubing string 94 in the casing 88, and the motor 36 is operated to rotate the tubing string 94 by rotation of the lift rod string 20 to release the anchors, hangers or packers 98. A production packer 100 is released in the same way. Once the anchors, hangers or packers 98 and the production packer 100 are released, the tubing string may be raised or lowered in the casing 88 by adding or removing joints of the lift rod string 20 as described above. When the downhole tool 86 has been repositioned to a new location in the well bore, the motor 36 is operated to reset the anchors, hangers or packers 98 and the production packer 100.

After the anchors, hangers or packers 98 and the production packer 100 are reset, the latch tool 96 may be released from the latch point 92 using methods well known in the art. For example, if the latch tool 96 is a releasing spear, release is accomplished using a "bump down" to break the attachment. The releasing spear is then rotated two or three times to the right. The rotation moves a releasing spear mandrel up through a grapple of the releasing spear, forcing the grapple against a release ring and putting the spear in the released position. A straight upward pull will then generally free the spear, however, it is recommended that the spear be rotated slowly to the right when coming out. The motor 36 is operated to accomplish the rotation. The lift rod string 20 is then disassembled in reverse order of the process described above for adding joints to the lift rod string 20. After the latch tool 96 is withdrawn above the wellhead 12, the master valve in master valve spool 16 (see FIGS. 1–4) is closed and well pressure is bled off through the release valve 52 in the tool entry spool 18. The BOPs 22 are fully opened after the well pressure is bled off through the release valve 52, the latch tool 96 is stroked up through the BOPs and the last joint of the lift rod string 20 is removed. The apparatus 10 may then be disconnected from the top of the wellhead 12 and the well may be put back into production.

As will be understood by persons skilled in the art, the apparatus in accordance with the invention may be used to displace tubulars in a well bore that are not equipped with a telescoping joint. Spears, friction or slip type tools may be used as latch tools to grip downhole tubulars for displacing the tubulars to add or remove joints, as required. Because of the structure of the apparatus in accordance with the invention, this can be accomplished while well pressure is contained, as is well understood in the art.

The apparatus in accordance with the invention can also be used for downhole operations which require pressure containment. Such operations include the drilling out of permanent bridge plugs, cement plugs or any other obstruction in the casing. Normally, such operations are required when abandoned well bores must be re-entered. Consequently, the permanent bridge plugs, cement plugs or other obstruction in the casing are generally near the surface. In order to re-enter an abandoned well, the apparatus 10 in accordance with the invention is connected to a wellhead of the abandoned well bore. If the well bore is not equipped with a wellhead, a wellhead is installed before re-entry operations are begun.

After the apparatus is set up, a hydraulically driven bit is connected to the bottom of the tubular which is ran down through the apparatus and fluids are pumped through the tubular to operate the bit while the BOPs 22 contain any potential pressure release from the re-entered well bore. Consequently, the removal of permanent bridge plugs, cement plugs, or any other obstruction in the casing can be safely and economically performed without danger of release of concessive pressures or hydrocarbons from the re-entered well bore.

Although only a few processes for the relocation of a downhole tool has been described, it will be understood by those skilled in the art that the apparatus in accordance with the invention can be used for any of the processes described in applicant's copending application as well as processes that have yet to be discovered. For example, it can also be used to accomplish such tasks as setting plugs, packers or subsurface safety control valves in a production tubing string using the lift rod string 20 for running those components into the tubing string. As will be understood by those skilled in the art, there is no practical limit to the length of a lift rod string 20, so even deep well operations can be accomplished, if required. The light weight and versatility of the apparatus make it ideal for many operations now accomplished using much heavier rigs which are more expensive to construct and maintain.

Changes and modifications to the embodiments described above will no doubt become apparent to those skilled in the art. The scope of this invention is therefore intended to be limited solely by the scope of the appended claims.

I claim:

1. Apparatus for axially or rotationally displacing a downhole tool or a tubular in a well bore equipped with a wellhead, comprising:

a lift rod string;

at least one annular seal for containing well pressure mounted above the wellhead, the annular seal providing a fluid seal around a periphery of the lift rod string;

means for axially displacing the lift rod string;

means for selectively rotating the lift rod string; and means for releasable engagement with the downhole tool or the tubular to be displaced.

2. Apparatus as claimed in claim 1 further including a swivel joint for enabling free rotational movement in a link rod between the means for axially displacing the lift rod string and the means for selectively rotating the lift rod string.

3. Apparatus as claimed in claim 1 further including a tool entry spool adapted to be mounted to a top of the wellhead.

4. Apparatus as claimed in claim 1 wherein the apparatus further includes a tool window in a spool located above the annular seal for enabling the lift rod string to be selectively gripped to inhibit axial and rotational movement thereof.

5. Apparatus as claimed in claim 4 wherein the spool with the tool window has a top flange and a bottom flange and the tool window is located between the top flange and the bottom flange to permit gripping or locking tools to engage the lift rod string through the tool window.

6. Apparatus as claimed in claim 5 wherein the tool window is provided in each side of the spool.

7. Apparatus as claimed in claim 4 wherein the apparatus further includes:

a lower support plate attached to a top of the spool having the tool window; and an upper support plate supported above the lower support plate by at least three support posts.

8. Apparatus as claimed in claim 7 further including a travelling support plate that is attached to a stem for connection of the lift rod string and displaceable between the lower support plate and the upper support plate, the travelling support plate engaging the support posts for guidance as it is displaced between the upper and lower support plates.

9. Apparatus as claimed in claim 8 wherein the apparatus further includes at least three support legs which extend between the lower support plate and a ground surface surrounding the wellhead.

10. Apparatus as claimed in claim 9 wherein each support leg includes an adjustable footpad which may be axially extended or retracted to accommodate variations in elevation of the ground surface.

11. Apparatus as claimed in claim 8 wherein the means for selectively rotating the lift rod string is mounted to the travelling support plate.

12. Apparatus as claimed in claim 11 wherein the means for selectively rotating the lift rod string is a hydraulic motor.

13. Apparatus as claimed in claim 7 wherein the means for axially displacing the lift rod string is mounted to the upper support plate.

14. Apparatus as claimed in claim 13 wherein the means for axially displacing the lift rod string comprises a hydraulic cylinder.

15. Apparatus as claimed in claim 14 wherein a polished rod is attached to a top of a piston of the hydraulic cylinder and extends through a top of the cylinder, the polished rod having a length that exceeds a stroke of the piston and includes a connector on a free end thereof.

16. Apparatus as claimed in claim 15 wherein the polished rod, a piston, a cylinder rod, a swivel joint, the link rod and the lift rod string each include axial fluid recirculation bores to permit fluid to be circulated through the lift rod string when required.

17. Apparatus as claimed in claim 15 wherein the at least one annular seal for containing well pressure is an annular preventer.

18. Apparatus as claimed in claim 17 wherein the annular preventer is a blowout preventer.

19. Apparatus as claimed in claim 7 wherein the means for selectively rotating the lift rod string is mounted to the upper support plate.

20. Apparatus as claimed in claim 19 wherein the means for selectively rotating the lift rod string is a hydraulic motor.

21. Apparatus as claimed in claim 7 wherein the apparatus further includes at least three support legs that extend between the lower support plate and a ground surface surrounding the wellhead.

22. Apparatus as claimed in claim 21 wherein each support leg includes an adjustable footpad that may be axially extended or retracted to accommodate variations in elevation of the ground surface.

23. Apparatus as claimed in claim 1 wherein the apparatus further includes a well slip assembly for enabling the lift rod string to be selectively engaged to inhibit rotational or axial movement of the lift rod string while joints are added or removed.

24. Apparatus as claimed in claim 23 wherein two well slip assemblies are oppositely oriented and mounted one atop the other.

25. Apparatus as claimed in claim 23 wherein the apparatus includes at least two adjacent blowout preventers.

26. Apparatus as claimed in claim 1 wherein the lift rod string comprises a plurality of joints that are respectively about as long as a length of travel of the means for axially displacing the lift rod string and each joint includes opposed peripheral areas of reduced diameter to provide parallel flat tool gripping surfaces that are adapted to be engaged by a clamping or securing device.

27. Apparatus as claimed in claim 1 wherein the lift means for axially displacing the lift rod string comprises a mechanical jack.

28. Apparatus as claimed in claim 27 wherein the mechanical jack is a ball jack.

29. Apparatus as claimed in claim 1 further comprising a link rod that includes a stub shaft connected to the means for selectively rotating the lift rod string, the stub shaft extending through the means for selectively rotating the lift rod string and including a stem for connection of the lift rod string.

30. Apparatus as claimed in claim 29 wherein a portion of the link rod is splined and a hub in a rotor of the means for selectively rotating the lift rod string is complimentarily splined, the splined portion of the link rod being reciprocatable through the hub of the means for selectively rotating the lift rod string as the lift means is reciprocated to displace the lift rod string, and a swivel joint is located above the splined portion of the link rod.

31. Apparatus as claimed in claim 1 wherein the means for releasable engagement with a latch point of the telescoping joint comprises any one of a releasing spear, a quick-release threaded joint, a slip tool, a releasable packer, key type tool, collet type tool, friction type tool or a rotary taper tap.

32. Apparatus as claimed in claim 1 the at least one annular seal is a blowout preventer.

33. Method for axially or rotationally displacing a downhole tool or a tubular in a well bore equipped with a wellhead, comprising the steps of:

a) mounting to the wellhead an apparatus for axially or rotationally displacing the tool or the tubular, the apparatus including a lift rod string; at least one annular seal for containing well pressure mounted above the wellhead, the annular seal providing a fluid seal around a periphery of the lift rod string; means for axially displacing the lift rod string; means for selectively rotating the lift rod string; and means for releasable engagement with the downhole tool or the tubular to be displaced;

b) operating the apparatus to move the lift rod string through the annular seal and the wellhead without releasing pressure from the well bore;

c) connecting the means for releasable engagement to the tubular or the downhole tool to be displaced;

d) operating the means for axially displacing and the means for selectively rotating the lift rod string, as required to displace the tubular or the downhole tool;

e) disconnecting the means for releasable engagement from the tubular or the downhole tool; and f) removing the lift rod string from the wellhead.

34. A method as claimed in claim 33 wherein the tubular includes a telescoping joint.

35. Method for piercing an obstruction in a well bore equipped with a wellhead, comprising the steps of:

a) mounting to the wellhead an apparatus for axially or rotationally displacing the tool or the tubular, the apparatus including a lift rod string; at least one annular seal for containing well pressure mounted above the wellhead, the annular seal providing a fluid seal around a periphery of the lift rod string; and means for axially displacing the lift rod string; means for selectively rotating the lift rod string;

b) connecting a tubular to the lift rod string, the tubular having an hydraulically driven drill bit mounted to a bottom end thereof;

c) operating the apparatus to move the tubular and the lift rod string through the annular seal and the wellhead without releasing pressure from the well bore;

d) operating the drill bit to drill through the obstruction while operating the means for axially displacing the lift rod string, as required, to displace the tubular downwardly as the drill bit is operated until the obstruction is pierced by the drill bit; and g) removing the lift rod string and the tubular from the well bore.

36. A method as claimed in claim 35 wherein the obstruction is one of a permanent bridge plug and a cement plug.

37. Method for dissolving soluble solids accumulated in a downhole tubular in a well bore equipped with a wellhead, comprising the steps of:

a) mounting to the wellhead an apparatus including a lift rod string; at least one annular seal for containing well pressure mounted above the wellhead, the annular seal providing a fluid seal around a periphery of the lift rod string; and means for axially displacing the lift rod string;

c) operating the apparatus to move the lift rod string through the annular seal and the wellhead without releasing pressure from the well bore to an area in the tubular where the solids to be dissolved are located;

d) pumping fluid for dissolving the solids through at least one axial bore in the lift rod sting to dissolve the solids while operating the means for axially displacing the lift rod string as the solids are dissolved, if required; and h) removing the lift rod string and the tubular from the well bore after the solids are dissolved.

38. A method as claimed in claim 37 wherein the solids are one or more of ice, hydrates, paraffin and asphaltines.

39. A method as claimed in claim 37 wherein the fluid pumped is one or more of water, a water-salt mixture and a hydrocarbon solvent or a mixture of hydrocarbon solvents.

40. A method as claimed in claim 39 wherein the fluid is heated before it is pumped through the lift rod string.

* * * * *